US007766773B1

(12) United States Patent
Gait

(10) Patent No.: US 7,766,773 B1
(45) Date of Patent: Aug. 3, 2010

(54) RUNNER SHOCK

(75) Inventor: Paul Gait, Syracuse, NY (US)

(73) Assignee: J. deBeer & Son, Inc., St. Louis, MO (US)

( * ) Notice: Subject to any disclaimer, the term of this patent is extended or adjusted under 35 U.S.C. 154(b) by 376 days.

(21) Appl. No.: 11/724,031

(22) Filed: Mar. 14, 2007

(51) Int. Cl.
*A63B 59/02* (2006.01)
*A63B 65/12* (2006.01)

(52) U.S. Cl. ..... 473/513; 473/505; D21/724

(58) Field of Classification Search ..... 473/505, 473/512, 513; D21/724; 267/166
See application file for complete search history.

(56) References Cited

U.S. PATENT DOCUMENTS

| | | | | | |
|---|---|---|---|---|---|
| 331,892 | A | * | 12/1885 | Kelton | 267/73 |
| 2,710,753 | A | | 6/1955 | Lockwood | 273/96 |
| 3,507,495 | A | | 4/1970 | Tucker et al. | 273/96 |
| 4,022,477 | A | | 5/1977 | Pool | 273/96 |
| 4,037,841 | A | | 7/1977 | Lewis, Jr. | 273/96 |
| 4,049,273 | A | | 9/1977 | Pool | 273/96 |
| 4,138,111 | A | | 2/1979 | Rule | 273/96 |
| 4,153,251 | A | | 5/1979 | Pond | 273/96 |
| 4,270,756 | A | | 6/1981 | Ahlenfeld et al. | 273/326 |
| 4,657,260 | A | | 4/1987 | Brine, Jr. | 273/326 |
| 4,861,042 | A | | 8/1989 | Trettin | 273/326 |
| 4,938,480 | A | | 7/1990 | Lods | 273/326 |
| 5,048,843 | A | | 9/1991 | Dorfi et al. | 273/326 |
| 5,178,397 | A | | 1/1993 | Brine, Jr. | 273/326 |
| 5,425,541 | A | | 6/1995 | Ambros | 273/326 |
| 5,508,925 | A | | 4/1996 | Katayama et al. | 364/426 |
| 5,568,925 | A | | 10/1996 | Morrow et al. | 273/326 |
| 5,651,549 | A | | 7/1997 | Dill et al. | 473/513 |
| 5,935,026 | A | | 8/1999 | Dill et al. | 473/513 |
| 5,938,550 | A | | 8/1999 | Hexemer et al. | 473/513 |
| 6,066,056 | A | | 5/2000 | Morrow | 473/513 |
| 6,447,410 | B2 | * | 9/2002 | Crawford | 473/513 |
| 6,533,686 | B2 | * | 3/2003 | LeMire | 473/513 |
| 6,561,932 | B2 | | 5/2003 | Morrow et al. | 473/513 |
| 6,723,134 | B2 | | 4/2004 | Tucker, Sr. | 473/513 |
| 6,910,976 | B2 | * | 6/2005 | Tucker, Sr. | 473/513 |
| 7,044,868 | B2 | * | 5/2006 | Brine et al. | 473/513 |
| 7,214,151 | B1 | * | 5/2007 | Gait | 473/513 |
| 2001/0044347 | A1 | | 11/2001 | Crawford | |
| 2002/0113352 | A1 | * | 8/2002 | Edwards | 267/166 |
| 2003/0030204 | A1 | * | 2/2003 | Chou | 267/177 |
| 2003/0178758 | A1 | * | 9/2003 | Metelski | 267/166 |

OTHER PUBLICATIONS

U.S. Appl. No. 60/305,671, filed Jul. 16, 2001, by Paul Gait.

* cited by examiner

*Primary Examiner*—Gene Kim
*Assistant Examiner*—M Chambers
(74) *Attorney, Agent, or Firm*—Waddey & Patterson, P.C.; Ryan D. Levy

(57) ABSTRACT

A shock for a lacrosse head comprising an energy absorbing element for use with a lacrosse head.

11 Claims, 7 Drawing Sheets

RUNNER SHOCK

BACKGROUND OF THE INVENTION

1. Technical Field

The present invention relates to a shock utilized in conjunction with a lacrosse head for dissipating energy. More particularly, the present invention relates to a shock-absorbing device used with a lacrosse head which allows for a greater ease in catching a lacrosse ball by absorbing energy into the energy-absorbing element of the shock. The invention also includes the novel device integrated into a lacrosse head as well as a strung lacrosse head having the device.

2. Background of the Art

The lacrosse game originated with the American-Canadian Native Americans. Traditionally, a lacrosse stick has a handle portion attached to a head with the head consisting generally of a frame and a pocket. It will be appreciated by those of ordinary skill in the art that a well constructed lacrosse head is essential in both the general play by and especially the success of participants of the sport of lacrosse. Generally, the lacrosse head can be described as a basket that attaches to the end of the handle that is used to catch, transport, and deliver the ball as desired. The lacrosse head not only catches the ball and holds the ball during play, but is also used during the defensive maneuvers and to obtain the ball during a face off. As such, the lacrosse head is subjected to both large and varying forces during the game. Typically, lacrosse heads are formed of some type of plastic material which is rigid although can slightly deform so as not to crack or break under the typical stresses experienced during participation in lacrosse games.

Traditionally, the pocket for the lacrosse head is strung by the player as the stringing of the pocket dictate the performance characteristics of the lacrosse stick. There are currently at least three popular ways to construct a lacrosse pocket.

A traditional lacrosse pocket includes braided nylon or polyester lace woven between side walls in longitudinal runners. The runners are traditionally leather or braided nylon and run between the scoop and inside throat area of the lacrosse head. The pocket is woven into the head with a standard traditional pocket comprising about four runners, cross-lacing, and side-wall stringing though is not limited to the described design. These materials are typically hand woven or strung in the traditional manner to form a pocket.

A mesh pocket typically includes machine-woven nylon which is pre-manufactured and attached to the side wall scoop and inside throat area via string. The mesh pockets include polyester or nylon material woven together to create a mesh with a diamond-like arrangement. This mesh material is machine made and is the integral body of the pocket.

Additionally, a third type of pocket includes a traditional and mesh integration into which a head is strung with a combination of pre-manufactured mesh, hand woven lace, and longitudinal runners.

Generally, a difficult aspect of lacrosse for a beginner player is the act of catching a lacrosse ball in the pocket of a lacrosse stick. When trying to catch a hard pass, the ball has a tendency to hit the pocket and bounce out unless the player adequately moves the stick so that the ball's momentum will not force the ball to eject from the pocket. Generally, a variety of lacrosse heads have been designed to dissipate energy although none have been aptly designed to dissipate energy from a ball entering the pocket. For example, in Tucker et al., U.S. Pat. No. 3,507,495, a lacrosse head is described which can deform slightly and recover and which can absorb shock when impacted or otherwise stressed. As such, the '495 head allegedly will also tend to reduce the force of contact between opposing players and not be as likely to break or shatter.

U.S. Pat. No. 6,447,410 issued to Crawford, teaches a lacrosse stick pocket with a flexible tube-like polymer thong and shooting string which has controlled stretching properties allowing for a greater absorption of shock and softer pocket area for receiving thrown balls.

Tucker, Sr. (U.S. Pat. No. 6,723,134) teaches a multi-component lacrosse head which has side wall overlays that provide both shock absorption and a high co-efficient of friction between the inside face of the side wall of the lacrosse stick and a lacrosse ball. Allegedly, the side wall overlays assist in deadening impact from balls thereby eliminating rebound within the pocket and improving ball control.

In Brine et al., U.S. Pat. No. 7,044,868, a lacrosse head is described wherein at least a portion of each side wall comprises a material that is softer than the material of at least the scoop so that the side walls dampen movement of a lacrosse ball, and thus, act as a shock absorber when the ball is received or moves around in the pocket.

Unfortunately, prior art attempts to alleviate shock when a ball is received, are not effective as typically the dynamics of the lacrosse head are altered or the pocket has an unnatural feel as different runners are utilized. Furthermore, the prior art does not provide options for changing the amount of shock absorption, thus requiring a player to change lacrosse heads if a different amount of shock absorption is required. In addition, the prior art does not include a shock absorption feature for the runners which run longitudinally from the scoop to the throat of a lacrosse stick.

What is desired, therefore, is a shock for a lacrosse stick which assists in dissipating energy from receiving a ball and connects to a runner of the lacrosse stick. Furthermore, a shock absorber is desired wherein the player can change the shock absorption characteristics of the lacrosse head. Indeed, a combination of characteristics, including alleviating shock from receiving a ball more efficiently than contemplated in the prior art have been found to be necessary for improving the dissipation of energy in lacrosse heads. Also desired is a strung lacrosse head with a shock.

SUMMARY OF THE INVENTION

The present invention provides a shock for a lacrosse head which is uniquely capable of dissipating energy from receiving a lacrosse ball in the pocket of a lacrosse stick. The inventive shock allows for the use of a variety of lacrosse pockets and head designs while providing a combination of improved ball handling characteristics and energy dissipation not heretofore seen. In addition, the novel shock for a lacrosse head, with the energy absorbing element, provides for a user to either change or remove the energy absorbing element thus customizing the energy absorption characteristics of the shock of the lacrosse head.

More particularly, the inventive shock includes an energy absorption element located adjacent to the frame of the lacrosse stick. The energy absorbing element may assist in dissipating energy through either the compression of the energy absorption element or the expansion of the energy absorption element, thus transferring the energy associated with the receiving lacrosse ball into the temporary deformation of the energy absorption element. Generally, the energy absorption element can be a compressible polymer including a variety of rubbers, plastics, thermoplastics, or the like and can also include a variety of springs comprised of metals or polymers. Preferably, a rubber material may be used and provides an energy absorption element through the compression of the rubber energy absorption element.

The shock for the lacrosse head should also have at least one connection point for connecting the shock to the pocket of the lacrosse head. Preferably, the shock is connected to a runner of the pocket of the lacrosse head. Additionally, multiple shocks may be utilized with each shock corresponding to a different runner of the pocket of a lacrosse head, thereby providing shock absorption characteristics to a substantial portion of the pocket.

In further embodiments, the shock for a lacrosse head may include a support member for maintaining the shock adjacent to a lacrosse frame. Preferably, the support member may encompass a substantial portion of the energy absorbing element of the shock, and most preferably, is integrated into the frame of the lacrosse head near the throat area of the frame. Generally, the support member is cylindrical in design, although can be designed in a variety of characteristics to complement the shape and size of the energy absorbing element of the shock.

Most often, the shock for the lacrosse head may be located at the throat area of the frame of the lacrosse head and can receive the runners running longitudinally from the scoop to the throat area. This location for one or more shocks is preferable as the characteristics of the head and pockets are not altered by including a shock near the scoop or side walls and furthermore, any excess weight added by the inclusion of shocks is kept lower on the lacrosse head.

The energy absorbing element of the shock for a lacrosse head may include an opening extending longitudinally there through the element preferably being a channel from a first side of the energy absorbing element to the second side of the energy absorbing element. In one embodiment, an energy transfer element may be disposed within this channel which connects to a runner and is utilized to transfer energy from a received ball to the energy absorbing element of the shock. In a further embodiment, a runner of a lacrosse pocket attached at the frame of the head may extend through the channel within the energy absorbing element and be secured at the opposite side of the shock.

Advantageously, the novel shock for lacrosse head with the energy absorbing element is preferably utilized in a traditional strung lacrosse head although may also be included in a mesh strung lacrosse head wherein the side wall runners connect to the shocks. An object of the invention, therefore, is a shock for a lacrosse head having characteristics which enable it to provide for greater ease when receiving a ball into the pocket of the lacrosse head.

Another object of the invention is a shock for a lacrosse head having an energy absorbing element and a connection point for connecting to the pocket of a strung lacrosse head.

Still another object of the invention is a shock for lacrosse head having a polymeric or rubber energy absorbing element within the shock.

Yet another object of the invention is a shock for lacrosse head which can be easily changed or altered by the user.

Yet another object of the invention is to provide a lacrosse head integrated with the novel shock.

These aspects and others that will become apparent to the artisan upon review of the following description can be accomplished by providing a shock with an energy absorbing element and at least one connection point in communication with the energy absorbing element of the shock.

DETAILED DESCRIPTION OF THE PREFERRED EMBODIMENTS

Figure 1:
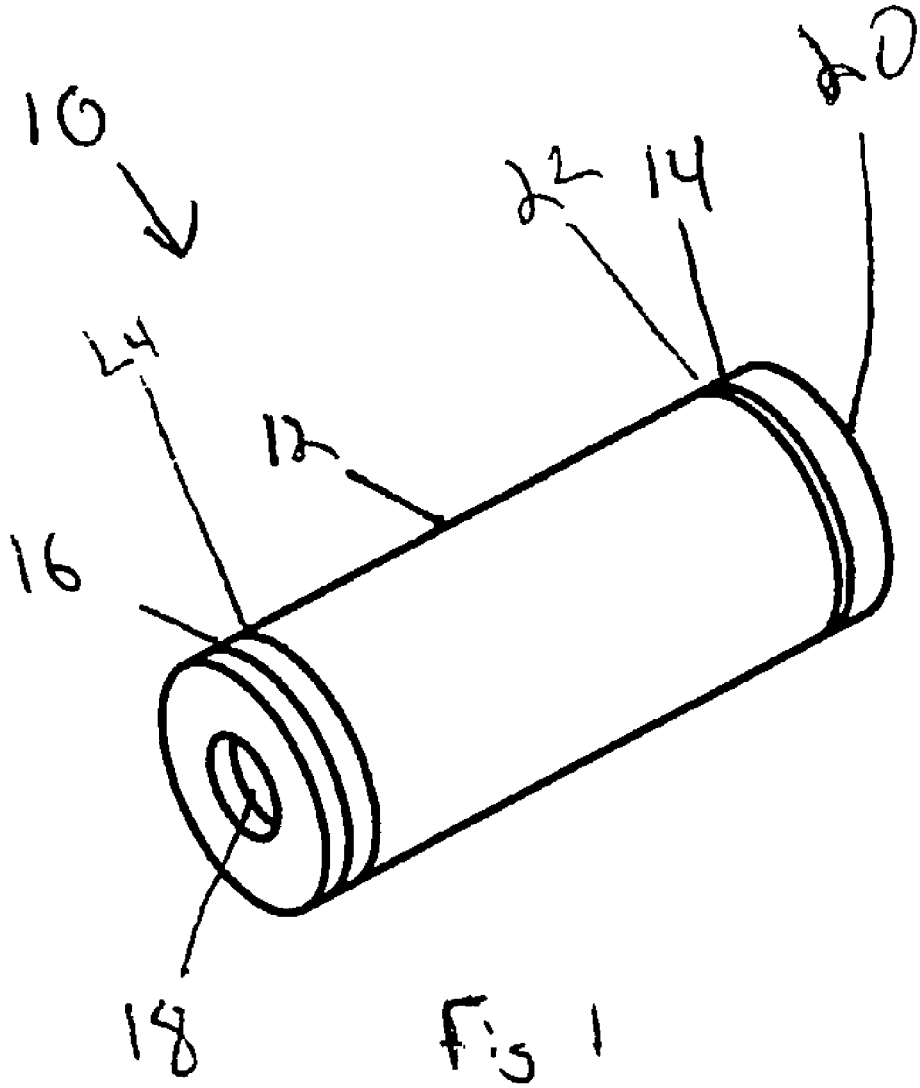
FIG. 1 is an illustration of a side-view of an embodiment of the shock for a lacrosse head.

Referring generally now to FIG. 1, a shock for lacrosse head made in accordance with the current disclosure is shown and generally designated by the numeral 10. Shock 10 is used with a lacrosse head (not shown) to provide for the dissipation of energy from receiving a ball in the pocket of a strung lacrosse head. Shock 10 includes energy absorbing element 12 and connection point 20 which is the general location at which a runner of a lacrosse head attaches to shock 10.

In a preferred embodiment, energy absorbing element 12 may be a deformable material which may include, but is not limited to, a variety of rubbers, polymers, plastics, thermoplastics, combinations thereof, and other compressible materials which can be utilized to dissipate shock. Generally, energy absorbing element 12 may be cylindrical in design although may also be rectangular and most often has a longitudinal length measured from first side 22 to second side 24, which is greater than the width of the energy absorbing element 12. However, in other embodiments, the width of energy absorbing element 12 may be greater than the longitudinal length resulting in a shorter shock 10. Energy absorbing element 12 is selected from the above materials so that shock 10 may absorb energy from the receiving of a ball into a lacrosse head by the temporary deformation of energy absorbing element 12.

Also included in further embodiments are proximal containment element 14 and distal containment element 16 which respectively fit on first side 22 and second side 24 of energy absorbing element 12 of shock 10. Proximal containment element 14 and distal containment element 16 may be comprised of a variety of materials including plastics, polymers, metals, or other rigid materials which are used to support and align energy absorbing element 12 of shock 10. Generally, proximal containment element 14 and distal containment element 16 comprise a washer design wherein the elements are cylindrical with an opening in the center of each element.

Inner space 18 is generally an opening, running longitudinally from first side 22 to second side 24 of energy absorbing element 12. In one embodiment, runners comprising the pocket of a strung lacrosse head run to the throat area of the lacrosse head and through inner space 18 and are secured adjacent to distal containment element 16. Alternatively, an energy transfer element (not shown) may extend through inner space 18 and attach to the runners of the pocket.

Figure 2:
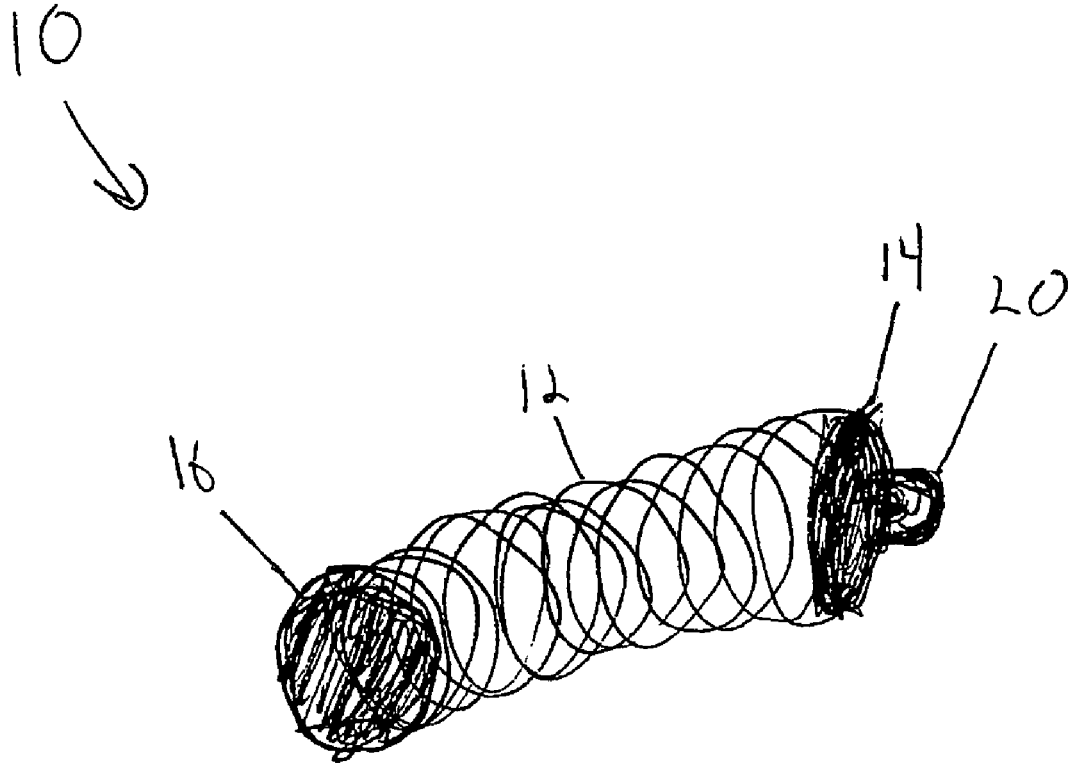
FIG. 2 is an illustration of a side-view of a further embodiment of the shock for a lacrosse head.

Referring now to FIG. 2, an alternative embodiment of shock 10 is presented. In this embodiment, energy absorbing element 12 comprises a spring design which may either compress or expand to dissipate energy resulting from a ball being received within a strung lacrosse head. Preferably, energy absorbing element 12 stretches through connection with a runner of the pocket at connection point 20 to absorb energy resulting in the receiving of a ball.

In both FIG. 1 and FIG. 2, energy absorbing element 12 is temporarily deformable to absorb the mechanical energy of a ball being received within a strung pocket of a lacrosse head. Preferably, a rubber or polymeric material is utilized as energy absorbing element 12 and is momentarily compressed when stress or force is placed upon the runners throughout the lacrosse pocket. Alternatively, as illustrated in FIG. 2, a spring-type element may be utilized as energy absorbing element 12 and may instead stretch to dissipate energy placed upon the pocket.

Generally, the deformation characteristics of the energy absorbing element 12 provide for differing degrees of shock absorption for the pocket. For example, a rubber material which deforms more easily under force may provide a "softer" pocket as the shock would provide the runner connected to the shock a greater range of travel until the energy absorbing element returns to a less deformed state. Conversely, a harder rubber material used as energy absorbing element 12 would result in a pocket with less "give" as the shock would deform less and provide a lesser range of motion to the connected runner.

Figure 3B:
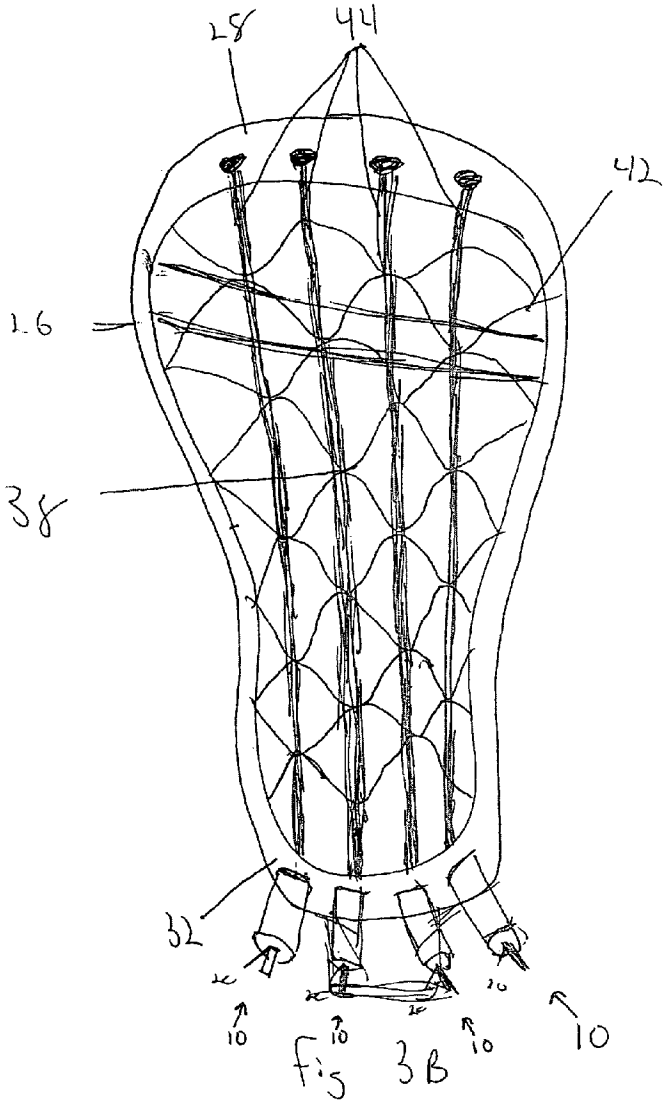
FIG. 3*b* is an illustration of a rear view of an embodiment of the shock used with a traditional strung lacrosse head.
Figure 3A:
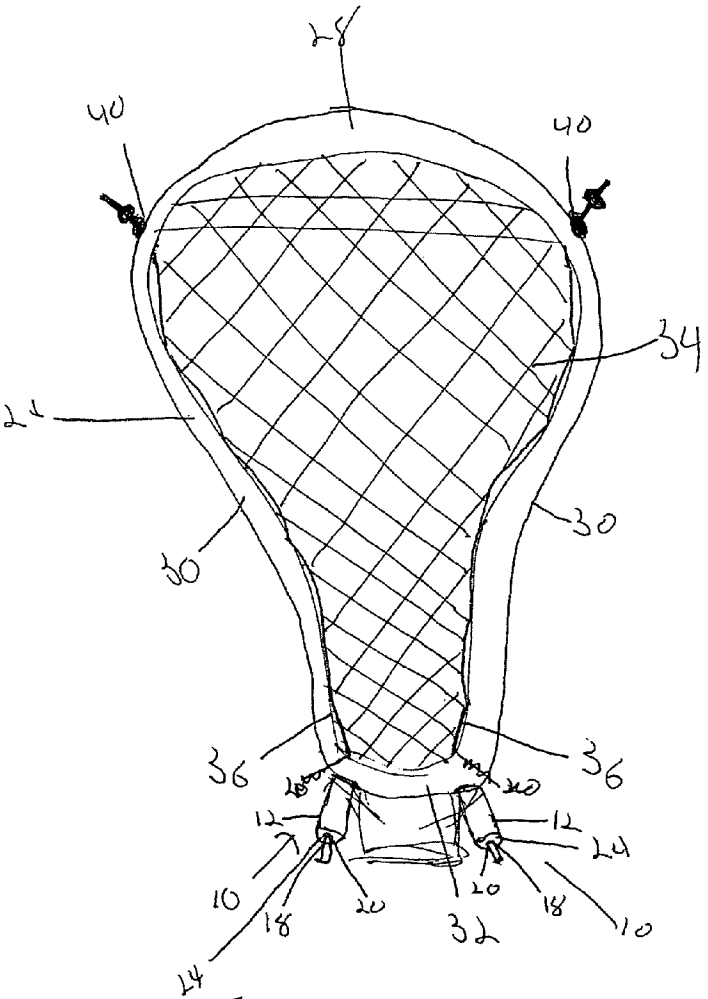
FIG. 3*a* is an illustration of a rear view of an embodiment of the shock used with a mesh strung lacrosse head.

Referring now to FIGS. 3*a* and 3*b*, there is shown a simplified example of a general embodiment of shock 10 used in conjunction with a mesh strung lacrosse head and a traditionally strung lacrosse head. In FIG. 3*a*, lacrosse head 26 includes scoop 28, sidewalls 30, throat 32, and mesh pocket 34. Furthermore sidewall runners 36 may be included to attach mesh 34 to lacrosse head 26 to form pocket 38 of lacrosse head 26. Specifically, sidewall runners 36 may run from scoop 28 to throat 32 and attach to two separate shocks 10 at throat 32. In the illustrated embodiment, shock 10 includes energy absorbing element 12 and inner space 18 wherein runners 36 are feed through inner space 18 and connect at second end 24 of energy absorbing element 12 to form connection point 20. At connection 20, sidewall runners 36 may be knotted, stapled, or otherwise adhered to second end 24 of energy absorbing element 12 to maintain sidewall runners 36 and shock 10 connected at connection point 20. Thus, when force is applied to pocket 38 of lacrosse head 26, tension is placed upon sidewall runners 36 resulting in the runners pulling on scoop connection 40 and also shock 10. Energy absorbing element 12 undergoes a temporary deformation as tension from sidewall runners 36 is placed at connection 20 of each shock 10, thus absorbing a portion of the energy administered to pocket 34. Without the use of shock 10 on each sidewall runner 36, the user of the lacrosse head would feel a significantly greater amount of force as sidewall runners 36 would be pulling on the rigid scoop attachment points 40 and throat area 32. By use of the shock 10, a softer pocket is created as the energy absorbing element 12 of shocks 10 provide for a slight give in the range of motion of sidewall runners 36 upon the application of force to mesh 34 of pocket 38.

FIG. 3*b* depicts lacrosse head 26 strung with traditional pocket 42 having multiple runners 44 which run from scoop 28 to throat area 32 and connect with shocks 10. Additional shocks 10 may be utilized for sidewall runners (not shown) or alternatively, less than all runners 44 may have shocks 10. In this configuration, when force is applied to pocket 38 of lacrosse head 26 of FIG. 3*b*, each shock 10 slightly compresses and provides for a softer pocket as when compared to runners attached rigidly to a scoop and the throat of a prior art lacrosse head.

From both FIG. 3*a* and FIG. 3*b*, the attachment of runners 44 and sidewall runners 36 at connection point 20 of shocks 10, provide for the energy absorbing element to slightly deform by compressing under the increased tension in the runners. When compared to a prior art lacrosse head, shocks 10 absorb and dissipate a portion of the energy transfer to the runners. In lacrosse sticks without the use of the novel shock, the runners would be rigidly attached to the throat and scoop area and would not experience the deformation or dissipation of energy as lacrosse heads are typically fairly rigid and do not substantially flex or deform upon force being applied to the pocket. Thus, the use of the shocks on the runners provide an otherwise rigid lacrosse head and pockets a "softer" feel as the runners have a slightly greater range of motion upon the application of increasing tension as the energy absorbing element of the shocks compresses with increasing force applied to the runners. After the ball is received within pocket 38 of either the lacrosse head as illustrated in FIG. 3*a* or FIG. 3*b* and less tension is applied to shock 10, energy absorbing element 12 of shock 10 proportionately restore to their normal orientation.

Figure 4:
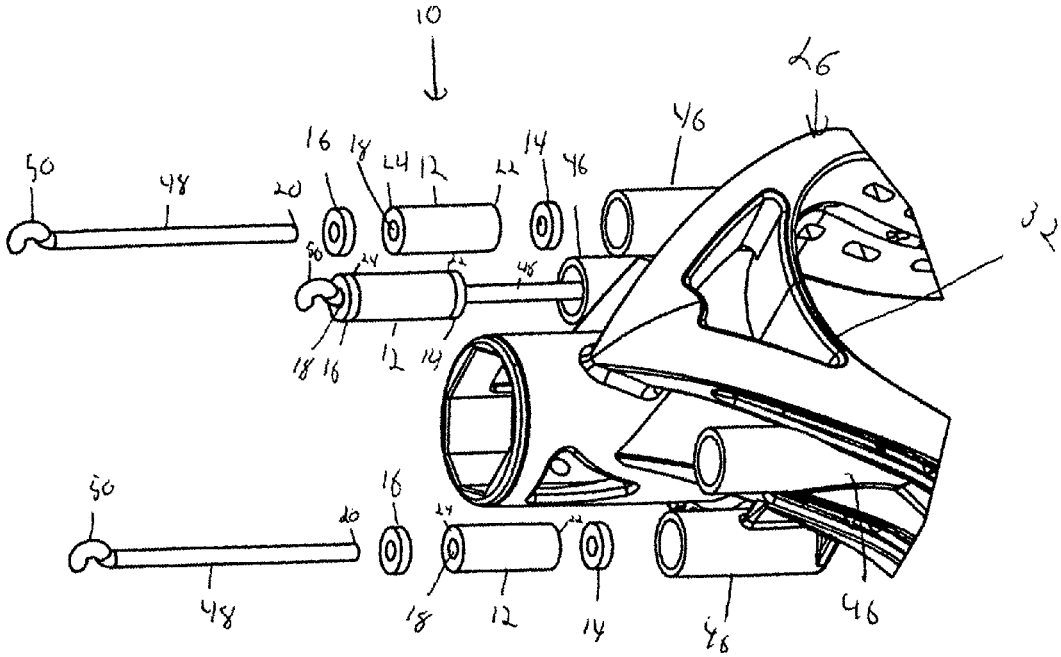
FIG. 4 is an illustration of the rear throat view of a preferred embodiment of a lacrosse head with integrated shocks.

Now referring to FIG. 4, there is generally illustrated the rear throat view of one embodiment of a lacrosse head with integrated shocks. In this embodiment, four energy absorbing element support members 46 are molded into lacrosse head 26. Alternatively, in other embodiments not illustrated, energy absorbing element support member 46 may be adhered or even removably attached to lacrosse head 26. In the current embodiment of FIG. 4, the four energy absorbing element support members 46 correspond to the use of four different energy absorbing elements 12 to create a lacrosse head 26 having four shocks 10. Most preferably, energy absorbing element support members 46 are created of the same material of which lacrosse head 26 is created, typically of a type of nylon or other polymer material which is at least semi-rigid and known in the art for molding lacrosse heads.

Both proximal containment elements 14 and distal containment element 16, generally embody a washer-type design and are respectively at first end 22 and second end 24 of energy absorbing element 12. Preferably, proximal containment element 14 and distal containment element 16 provide a buffer between the inner side (not shown) of energy absorbing element support member 46 and also the second end 24 of energy absorbing element 12 which would otherwise be exposed. Additionally, both proximal containment element 14 and distal containment element 16 include an opening which corresponds to the circumference of the opening of inner space 18 of energy absorbing elements 12. Thus, when proximal containment element 14 and distal containment element 16 are in direct contact with energy absorbing element 12, a continuous inner space is created by the combination of the opening and proximal containment element 14, distal containment element 16, and inner space 18.

Shocks 10 as embodied in FIG. 4 also contain energy transfer element 48 with connection point 20 and energy transfer stop 50 on the opposite ends of energy transfer element 48. Energy transfer element 48 extends through the opening in distal containment element 16, through inner space 18 and energy absorbing element 12, and also through the opening in proximal containment element 14 so that connection point 20 is exposed and able to connect to a runner (not shown) of a lacrosse pocket. Energy transfer stop 50 may function as to preclude energy transfer element 48 from being pulled through either the containment elements or energy absorbing element 12 upon tension applied to a runner connected to connection point 20 of energy transfer element 48.

Figure 5:
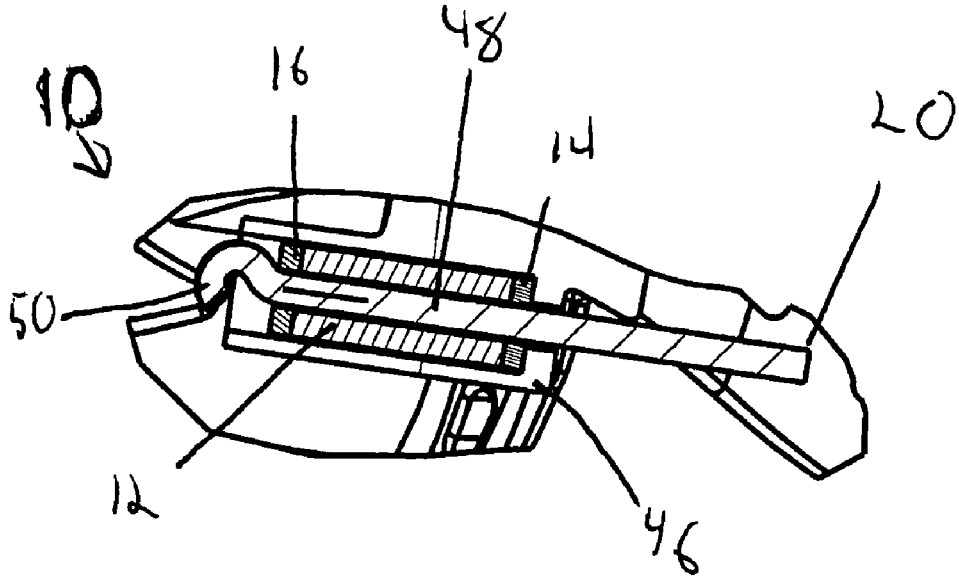
FIG. 5 is an illustration of a side view of a cut-away of the preferred embodiment of a shock.

A cutaway side view illustration of shock 10 in an operative arrangement is illustrated in FIG. 5. Here energy absorbing element 12 is contained between distal containment element 16 and proximal containment element 14 where proximal containment element 14 abuts the base of energy absorbing element support member 46. Energy transfer element 48 extends there through the openings in the containment elements and also inner space 18 with connection point 20 available in the pocket region to attach to a runner (not shown) of the pocket. The result of this mechanical arrangement is that when force or tension is applied to connection point 20 of energy transfer element 48, the combination of the energy transfer element 48 with energy transfer stop 50, and the containment elements and energy absorbing elements support member 46 cause the energy absorbing element 12 thus deforms, and absorbs a portion of the energy applied to connection point 20 through this deformation.

Figure 6:
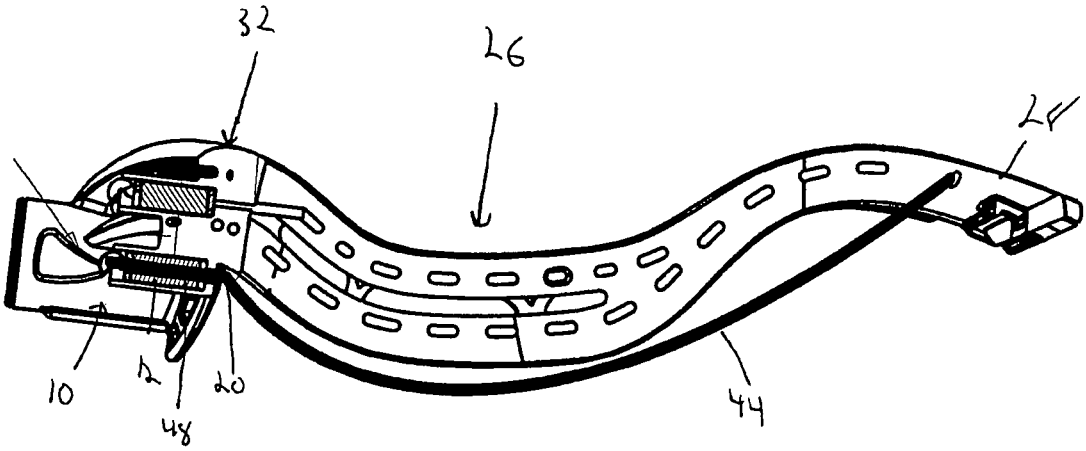
FIG. 6 is an illustration of a side view of a cut-away of the preferred embodiment of a shock with a partially strung lacrosse head.

FIG. 6 shows a more detailed example of how the novel shock may communicate with a runner through the use of a side view of a partially strung lacrosse head. In this illustration, runner 44 is strung from scoop 28 and attaches to connection point 20 of shock 10 thus precluding the rigid attachment of the runner to lacrosse heads 26 frame at throat 32. A variety of configurations could alternatively be designed and furthermore, the top most shock 10 could also be strung with another runner extended to the scoop 28 of lacrosse head 26. Obviously, lacrosse head 26, as illustrated in FIG. 6, would be strung further prior to play and in this illustration only includes one runner 48 to clearly depict the attachment of a runner from the scoop 28 to the shock 10 without the copious other stringing elements common to a strung pocket.

Figure 7:
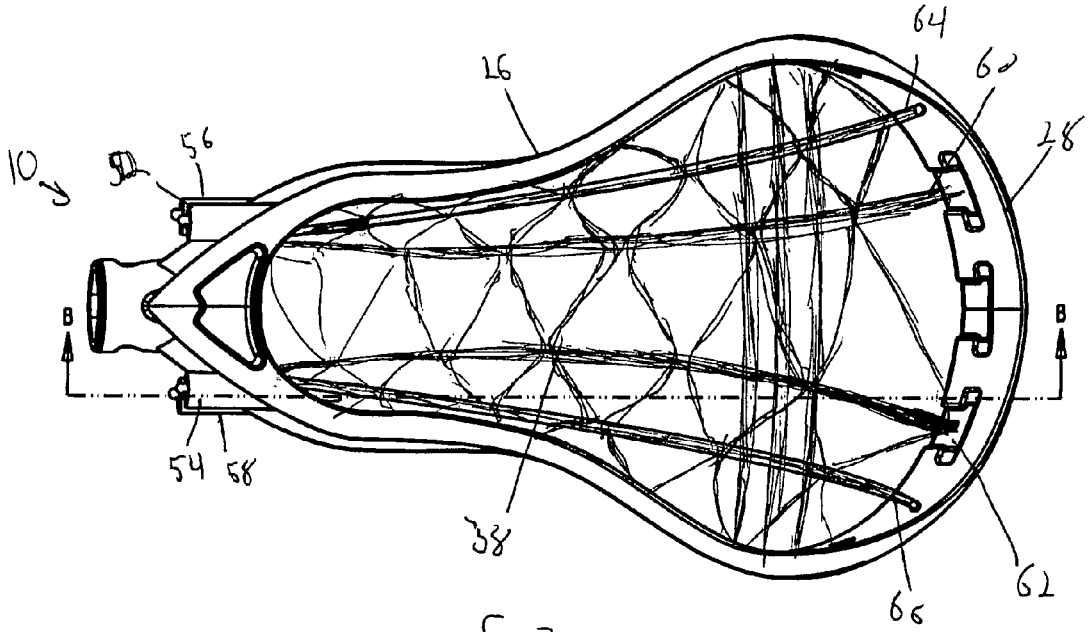
FIG. 7 is an illustration of a top view of the preferred embodiment of a lacrosse head with integrated shocks.

Shocks 10 as shown in use with a strung lacrosse head in FIG. 7 been individually numbered with the front shocks having numeric designations 52 and 54 and the rear shocks having numeric designations 56 and 58. Additionally, the runners have been individually numbered with runner 60 corresponding to shock 52, runner 62 corresponding to shock 54, runner 64 corresponding to shock 56, and runner 66 corresponding to shock 58. In this embodiment, the main runners comprising pocket 38 engage scoop 28 and shocks at the throat area of lacrosse head 26. This arrangement accomplishes a pocket with superior shock absorption as the main longitudinal elements running from throat to scoop, the runners, are each secured to a shock providing for energy absorption. This can result in less ricochet of a lacrosse ball as the energy transferred to the pocket and lacrosse head in catching the ball is absorbed as the energy absorbing elements of the shocks undergo a compression and temporary deformation.

In the multiple illustrations of the preferred embodiment, the energy transfer element is neither limited to a separate element nor the bare runner threading through the energy absorbing element of the shock. A preferable embodiment of the energy transfer element may also comprise the runner wrapped in a piece of tubing, with the wrapped runner passing within the energy absorbing element. The tubing may comprise plastics, rubbers, or polymers and can be placed around the portion of the runner extending exposed there after the formation of the pocket to comprise the energy transfer element.

The above embodiments are not intended to be a limitation of the scope of invention as a multiplicity of other embodiments using the novel shocks are available. For example, the shocks may be used on only a pair of runners such as the outside runners or inside runners or even furthermore, a player could determine the number of shocks the player desires. Additionally, the shocks utilized on a lacrosse head may use different energy absorbing elements thus providing different runners with different levels of energy of absorption. In one such embodiment, the outside runners may include a less deformable energy absorbing element where the inner runners could comprise a softer and more deformable energy absorbing element resulting in a lacrosse head with a pocket having greater shock absorbing features along the longitudinal center of the lacrosse head. Furthermore, the runners may be attached to the shocks in a variety of means including extending the runners through the inner space of the shock and attaching the runners at the distal end of the shock wherein the energy transfer elements would not be included in such design.

Other alternatives could also include utilizing the shock with differing types of pockets including hybrids of mesh and traditional or other such pockets that a player may desire. With the design of the shocks as discussed, it is possible to utilize the shocks in a variety of different pocket arrangements, thus allowing a player to couple the shock absorbing characteristics of the invention with the player's desired pocket arrangement.

Accordingly, by the practice of the present invention, a shock for a lacrosse head is disclosed. This shock exhibits improved energy absorption characteristics resulting in improved ball-handling control for a user.

The disclosures of all cited patents and publications referred to in this application are incorporated herein by reference.

The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A shock for a lacrosse head, the lacrosse head including a scoop, a throat, a front side, a back side, and a pocket with at least one runner, the shock comprising:

an energy absorbing element with a first side and a second side, the energy absorbing element being compressible for absorbing energy received at the pocket and transferred by the at least one runner to the energy absorbing element;

an energy transfer element with a distal end and a proximal end and extending longitudinally through the energy absorbing element from the first side of the energy absorbing element to the second side of the energy absorbing element with the proximal end of the energy transfer element comprising a connection point on the shock for connecting to one runner of the pocket of the lacrosse head;

and an energy absorbing element support member located adjacent to the throat of the lacrosse head for maintaining the energy absorbing element wherein the energy absorbing element and the one runner are in communication for providing the one runner a greater range of motion than a lacrosse head without the shock, the shock located at about the throat of the lacrosse head.

2. The shock of claim 1 wherein one of the at least one runner engages the throat and the connection point on the shock.

3. The shock of claim 1 further comprising a distal containment element in communication with the first side of the energy absorbing element.

4. The shock of claim 3 wherein the distal containment element comprises a washer.

5. The shock of claim 1 further comprising a proximal containment element in communication with the second side of the energy absorbing element.

6. The shock of claim 5 wherein the proximal containment element comprises a washer.

7. The shock of claim 1 further comprising an inner runner space extending longitudinally from the first side of the energy absorbing element to the second side of the energy absorbing element.

8. The shock of claim 7 further comprising one of the at least one runners extending through the inner runner space.

9. The shock of claim 8 further comprising tubing around at least the portion of the runner extending through the inner space.

10. The shock of claim 1 wherein one of the at least one runners engages the connection point of the proximal end of the energy transfer element and the scoop of the lacrosse head.

11. The shock of claim 1 wherein the energy absorbing element is removable.

* * * * *